United States Patent [19]

Wysocki

[11] 4,194,677

[45] Mar. 25, 1980

[54] CARTON WITH POUR SPOUT MADE FROM THE CARTON MATERIAL

[75] Inventor: Lawrence Wysocki, Chicago, Ill.

[73] Assignee: Champion International Corporation, Stamford, Conn.

[21] Appl. No.: 918,488

[22] Filed: Jun. 23, 1978

[51] Int. Cl.[2] ..... B65D 5/72

[52] U.S. Cl. ..... 229/17 R

[58] Field of Search ..... 229/17 R

[56] References Cited

U.S. PATENT DOCUMENTS

| | | | |
|---|---|---|---|
| 2,069,281 | 2/1937 | Sebreny | 229/17 R |
| 2,323,447 | 7/1943 | Chase | 229/17 R |
| 2,341,397 | 2/1944 | Smith | 229/17 R |
| 2,742,220 | 4/1956 | Lynes | 229/17 R |
| 3,017,065 | 1/1962 | Collie | 229/17 R |
| 3,184,137 | 5/1965 | Mohler | 229/17 R |
| 3,204,250 | 8/1965 | Poole et al. | 229/17 R |
| 3,568,910 | 3/1971 | McConnell | 229/17 R |

*Primary Examiner*—Davis T. Moorhead

*Attorney, Agent, or Firm*—Evelyn M. Sommer

[57] ABSTRACT

A pour spout for a carton is formed from the carton material in two superimposed panels. The outermost panel has an opening and a tab member, the first end of which is connected to the remainder of the panel at a fold line. The second or opposite end of the tab member is part of the perimeter of the opening. The first and second ends of the tab member are defined by parallel rows of perforations. The inner panel includes a tab member which is aligned with the first tab member. A pair of wing members extend from fold lines at opposite side edges of the inner tab member. The wing members may have an arcuate edge and may include a projection which will limit pivotal movement of the spout formed by the tab members and wing members. The superimposed panels may be overlapping side panels, overlapping top panels, or a combination of side panels and top panels having extensions which overlap the side panels. In one embodiment, a separate insert serves as the innermost panel.

15 Claims, 13 Drawing Figures

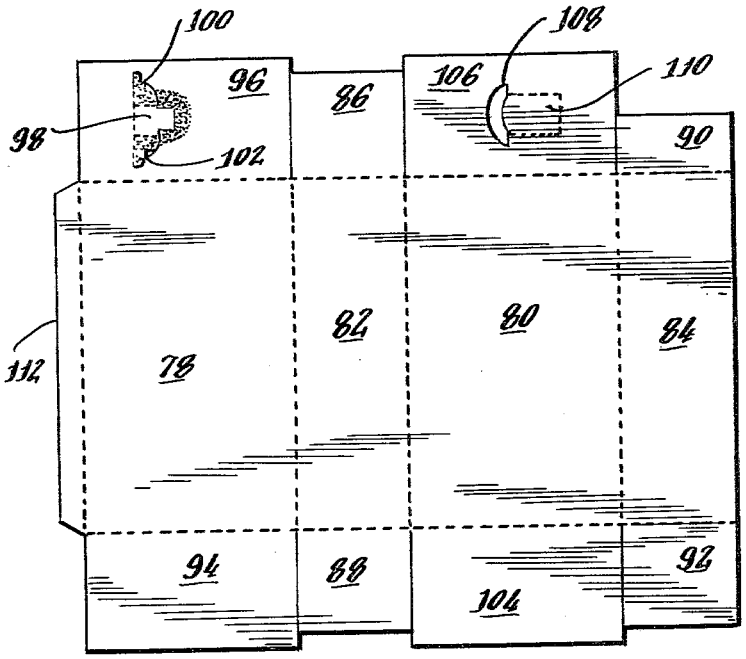
Fig. 6.
Fig. 5.
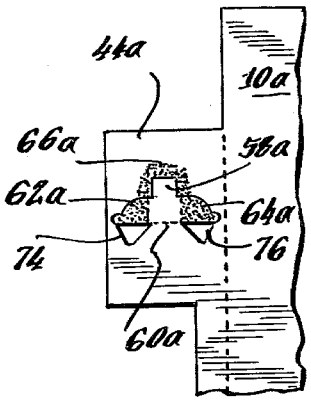
Fig. 7.
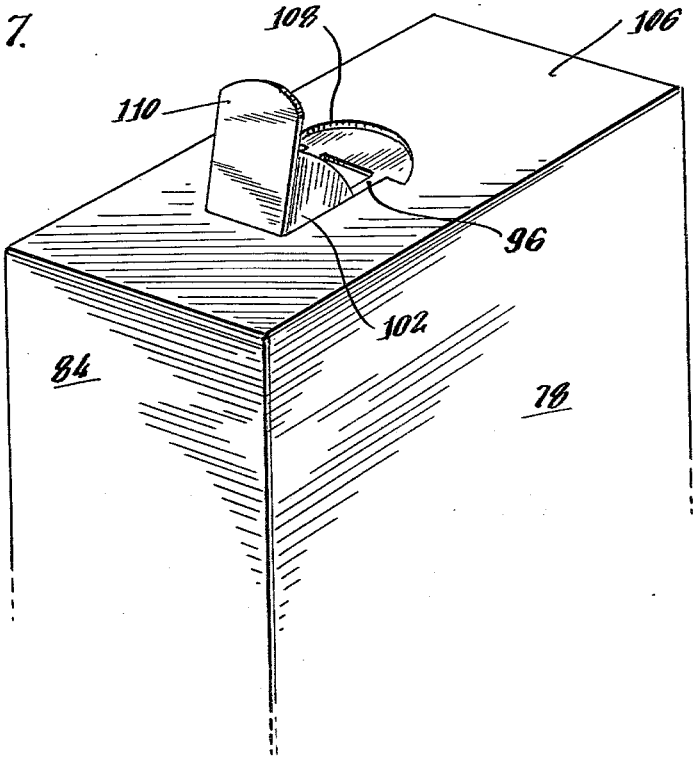

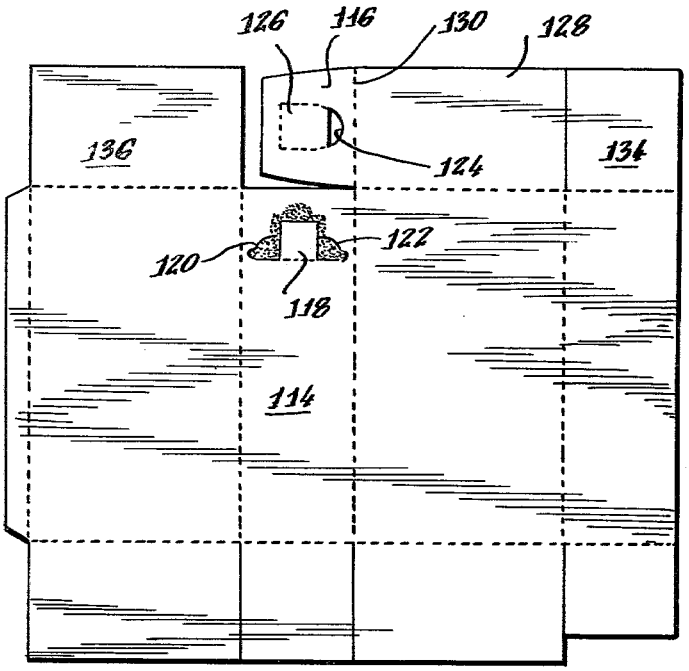
Fig. 8.
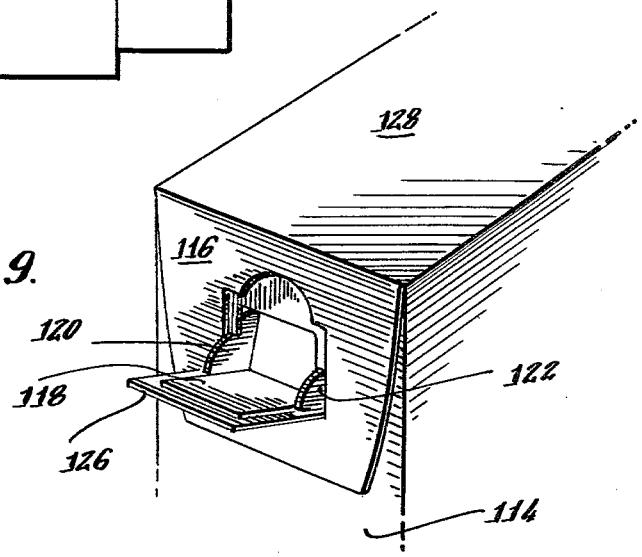
Fig. 9.
Fig. 10.
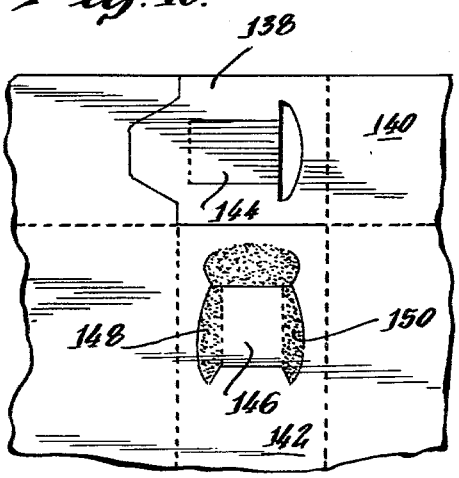
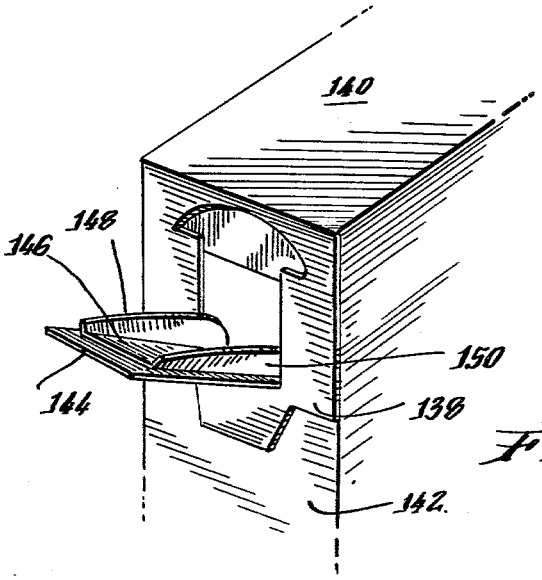
Fig. 11.

CARTON WITH POUR SPOUT MADE FROM THE CARTON MATERIAL

BACKGROUND OF THE INVENTION

The present invention relates to containers and more particularly to a container having a pour spout which is fabricated from the container material.

Granular bulk products such as sugar, salt, powdered detergents and the like, are sometimes marketed in containers including a small pouring chute or spout to facilitate dispensing of the product.

Prior art pour spouts have generally been made of thin metal or plastic formed to provide the floor and side walls of the spout. These formed spouts are attached to the inner wall of the container with the floor of the spout being aligned with an opening through the container side wall or top wall. To prevent leakage of the container contents and to prevent contamination of those contents prior to use, the spout area is normally sealed with an adhesive-covered strip or panel which is removed by the consumer when he is ready to use the container.

Since the spout is manufactured independently of the container and then installed within the container, the incremental manufacturing costs attributable to the use of prior art spouts is significant relative to the overall container costs, particularly where the container is made from a low cost material such as a coated paperboard material. Moreover, the types of materials (metals and plastics) from which prior art spouts have been made are relatively more expensive to begin with than the paperboard material from which a container may be made.

SUMMARY OF THE INVENTION

The present invention is a container pour spout construction which is made from the same materials as the carton into which it is incorporated. In a preferred embodiment, the pour spout is an integral part of the carton, being formed by fold lines and scoring cuts in the carton material.

The pour spout is made up from an outer panel which has an opening therethrough and an outer tab member. A first end of the tab member is connected to the remainder of the outer panel at a fold line. A second or opposite end forms part of the perimeter of the opening. The first and second ends of the tab member are connected by side edges. An inner panel is superimposed upon and secured to the outer panel over part of their facing surfaces. The inner panel includes an inner tab member which forms the spout floor. The inner tab member is connected to the remainder of the inner panel at a fold line which brings it into registry with the outer tab member. First and second integral wing members are connected to opposite side edges of the inner tab member at parallel fold lines. The wing members are deformed inwardly to form spaced side walls for the spout when the inner and outer tabs are pulled outwardly to open the spout.

DESCRIPTION OF THE DRAWINGS

While the specification concludes with claims particularly pointing out and distinctly claiming that which is regarded as the present invention, details of preferred embodiments of the invention may be more readily ascertained from the following detailed description when read in conjunction with the accompanying drawings wherein:

FIG. 5 is an enlarged plan view of an alternate embodiment of an inner panel for use with the carton of FIGS. 1-3;

FIG. 6 is a plan view of a blank for forming a carton having an integral pour spout in its top wall;

FIG. 7 is a partial perspective view of a carton made from the blank of FIG. 6;

FIG. 8 is a plan view of a blank for an alternate embodiment of the invention;

FIG. 9 is a partial perspective view of a container erected from the blank of FIG. 8;

FIG. 10 is an enlarged partial view of a carton blank, showing an alternate form of the invention;

FIG. 11 is a partial perspective view of a carton erected from the blank illustrated in part in FIG. 10;

DETAILED DESCRIPTION

Figure 1:
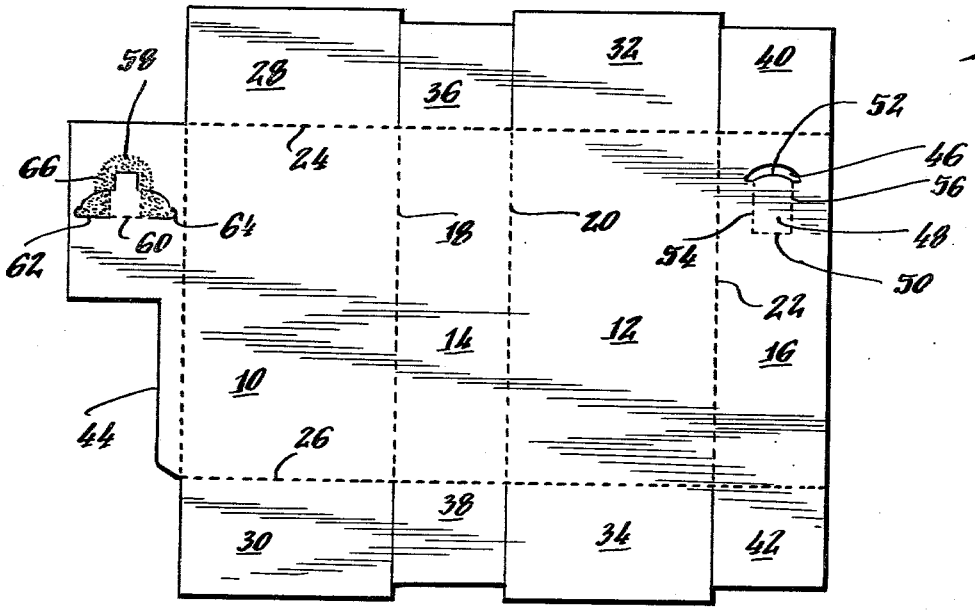
FIG. 1 is a plan view of a carton blank from which a carton having an integral pour spout may be erected.

Referring to FIG. 1, a carton constructed in accordance with the present invention may be made from a one piece blank of paperboard or other suitable, foldable sheet material. The blank includes a front panel 10, a back panel 12, a first side panel 14 defined in part by vertical fold lines 18 and 20, and a second side panel 16 extending from the back panel 12 at a vertical fold line 22. The upper and lower edges of the panels 10, 12, 14 and 16 are defined by fold lines 24 and 26, respectively. Each of the panels has upper and lower end closure or sealing panels extending from the fold lines. More specifically, front panel 10 includes a generally rectangular top closure panel 28 and a similarly shaped bottom closure panel 30. Back panel 12 similarly includes a top closure panel 32 and a bottom closure panel 34. The first side panel 14 includes a top sealing panel 36 and a bottom sealing panel 38. The second side panel 16 includes a top sealing panel 40 and a bottom sealing panel 42, each of which is substantially identical to the corresponding sealing panel associated with the first side panel 14.

The vertical dimensions of the panels 28, 30, 32 and 34 are substantially equal to the horizontal dimensions of the side panels 14 and 16. In the erected carton, the closure panels overlap one another completely. The sealing panels 36, 38, 40 and 42 are somewhat shorter than the closure panels with the vertical dimensions of the sealing panels preferably being no greater than one half the width of the front and back panels 10 and 12.

An integral pour spout is formed in the blank of FIG. 1 by cutting and perforating the second side panel 16 and a generally L-shaped glue panel 44 in a manner to be described. The second side panel 16 includes a generally crescent-shaped opening 46 and an outer tab 48. A first end of the tab 48 is defined by a fold line 50. The second end 52 of the tab 48 forms part of the perimeter of the opening 46. Opposite sides 54 and 56 of tab 48 are defined by heavily perforated lines.

Cooperating structure on the glue panel 44 includes an inner tab 58 connected to the glue panel 44 at a short fold line 60. First and second integral wing members 62 and 64 extend from fold lines at opposite side edges of the tab 58. The entire outer perimeter of the combination of tab 58 and wing members 62 and 64, except for the fold line 60, is heavily perforated or completely cut.

In erecting the carton, a coating of a suitable adhesive is applied to the entire surface of the glue panel 44. However, a glue retarding coating previously applied to the cross hatched area 66 will prevent the glue from adhering to that area. When the carton is actually erected, the area 66 will be free of any adhesives. Selected surfaces of the top and bottom closure panels and sealing panels are also coated with adhesives in a conventional manner.

To form a rectangular box from the blank shown in FIG. 1, the panels 10, 12, 14, 16 and 44 are deformed about the vertical fold lines to form a rectangular tube in which panel 44 is overlapped by panel 16. The top sealing panels 36 and 40 and the bottom sealing panels 38 and 42 are bent inwardly, after which the top closure panels 28 and 32 and the bottom closure panels 30 and 34 are folded into place and secured to each other by an adhesive coating on one of their facing surfaces.

Figure 2:
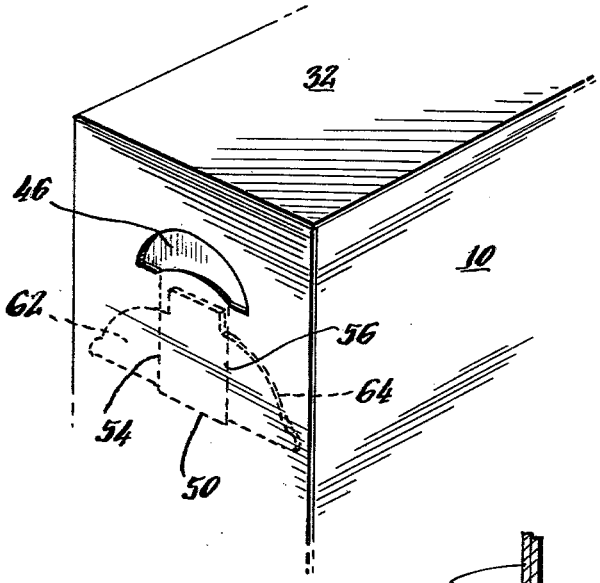
FIG. 2 is a perspective view of the exterior of a carton erected from the blank of FIG. 1 and showing the integral pour spout when closed.

Referring to FIG. 2, the side wall panel 16 overlies the entire glue panel 44 in the erected carton. The outer tab 48 in side panel 16 is aligned with the inner tab 58 in the glue panel 44. The tab members 48 and 58 are secured by an adhesive coating on the face of inner tab 58. The opening 46 in panel 16 provides a recess into which a consumer may insert a fingernail or a knife-like implement in order to pull the outer tab 48 (and attached inner tab 58) away from the side panel 16. When the tabs are pulled away from the side panel 16, the unperforated material along the side edges 54 and 56 of tab 48 yields allowing the tab 48 to pivot freely about the fold line 50.

Figure 3:
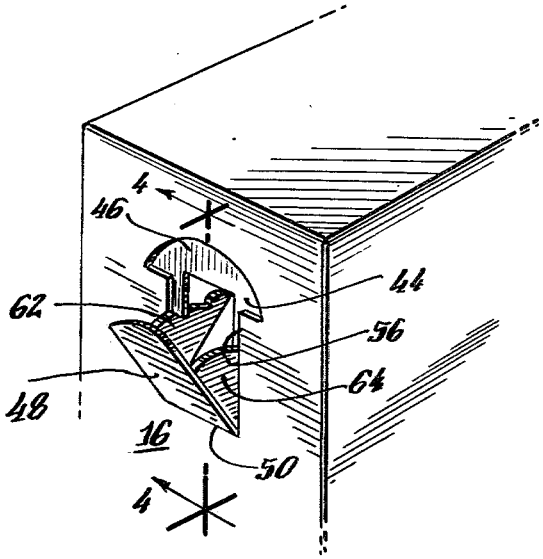
FIG. 3 is an exterior view showing the integral pour spout of the same carton when open.

Referring to FIG. 3, as the attached tabs 48 and 58 pivot outwardly about the fold line 50, the wing members 62 and 64 are forced toward one another as they rub along the side edges 54 and 56 of the opening formerly occupied by outer tab 48. The wing members 62 and 64 assume a generally upright position relative to tab 58 to form the side walls of a spout while the inner tab 58 forms the floor of the spout.

Figure 4:
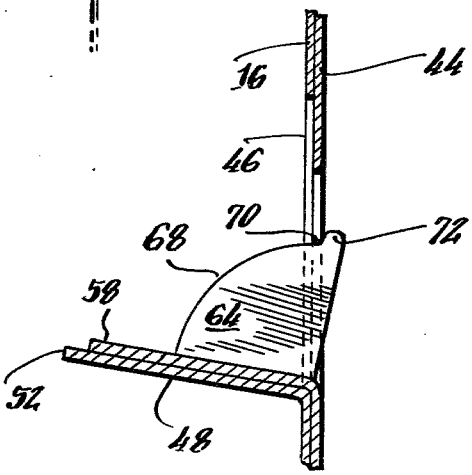
FIG. 4 is a cross sectional view of a pour spout taken along lines 4—4 of FIG. 3.

Referring to FIG. 4, the wing members 62 and 64 preferably include an arcuate edge 68 which rides along the upper edge of the opening 70 formed in glue panel 44 when the tab 58 and wing member 62 and 64 are broken away. Each of the wing members includes a small movement-limiting protrusion 72 which is pivoted into contact with the inner surface of the glue panel 44 at the upper edge of opening 70 when the pour spout is opened.

FIG. 5 is a partial view of an alternate embodiment of a glue panel which could be used in a carton of the type otherwise described with reference to FIGS. 1–4. With the exceptions noted below, the blank into which the glue panel of FIG. 5 would be incorporated is identical to the blank described with reference to the foregoing figures. Elements which have an exact counterpart in the previously-described carton are designated by using the same reference numeral was was used previously but in combination with a lower case "a". For example, the alternate embodiment of the invention has an inner tab 58*a* which is identical to the tab member 58 of the originally-described embodiment. Similarly, the spout-forming components includes wing members 62*a* and 64*a* attached to the tab member 58*a* at parallel fold lines. The crosshatched area 66*a* is coated with glue-retarding chemicals which exclude glue from the area. This embodiment adds triangular cutouts 74 and 76 which help to prevent binding of the wing members 62 and 64 when the pour spout is being opened in an erected carton.

While an integral spout has been shown as included within side walls of a container, it may be advantageous to provide a top-opening pour spout for certain kinds of products. Referring to FIG. 6, a blank suitable for making a carton with a top-opening pour spout includes rectangular front and back panels 78 and 80, respectively, a first side panel 82 and a second side panel 84. Each of these panels includes upper and lower closure and sealing panels. More specifically, the first side panel 82 has a top sealing panel 86 and a bottom sealing panel 88 while the second side panel 84 has a top sealing panel 90 and a bottom sealing panel 92. The front panel 78 includes a rectangular bottom closure panel 94 and a top closure panel 96. The top closure panel includes an inner tab 98 with wing members 100 and 102. The back panel 80 includes a bottom closure panel 104 and a top closure panel 106 having a generally crescent shaped opening 108 and an outer tap 110.

In erecting a carton from this blank, the panels 78, 80, 82 and 84 are formed into a rectangular tube with a relatively narrow glue panel 112 being secured to the inner surface of the side wall panel 84. The tuck panels 86 and 90 are folded inwardly first, followed by the top closure panel 96. The top closure panel 106 is folded into face to face contact with the panel 96 and secured thereto by means of an adhesive layer on panel 96.

FIG. 7 shows the carton erected from the above-described blank. Except for its placement in the top wall structure of the carton, the pour spout is identical to the pour spout employed in the carton described with reference to FIGS. 1–4.

In the embodiments described thus far, the inner and outer panels from which the pour spouts have been formed have been either both side panels or both top panels. FIGS. 8 and 9 illustrate an embodiment of the invention in which the inner panel is a side panel 14 while the outer panel is a panel 116 extending from one end of a top closure panel 128 at a fold line 130. In erecting a carton from this blank, a top sealing panel 134 is folded into the end of the rectangular tube formed by the front and back panels and the side panels. Top closure panel 136 is then folded into place, followed by top closure panel 128. The outer panel 116 is then bent downward at approximately right angles to the top panel 128, bringing it into face to face engagement with the upper portion of the side wall panel 114. The tabs 118 and 126 are bonded to complete the spout structure.

FIGS. 10 and 11 are a partial view of still another embodiment of the invention wherein the outer panel components are part of an extension 138 from a top closure panel 140. The inner panel components are formed in a side panel 142. In this embodiment, the outer tab member 144 is somewhat wider than the inner tab member 146. Moreover, the wing members 148 and 150 have smoothly varying edges which lack any movement-limiting projections at their inner ends. As a result, movement of the spout is not limited. The spout can be folded downward into contact with the surface of the side wall panel 142 to leave the opening into the container completely clear.

Figure 12:
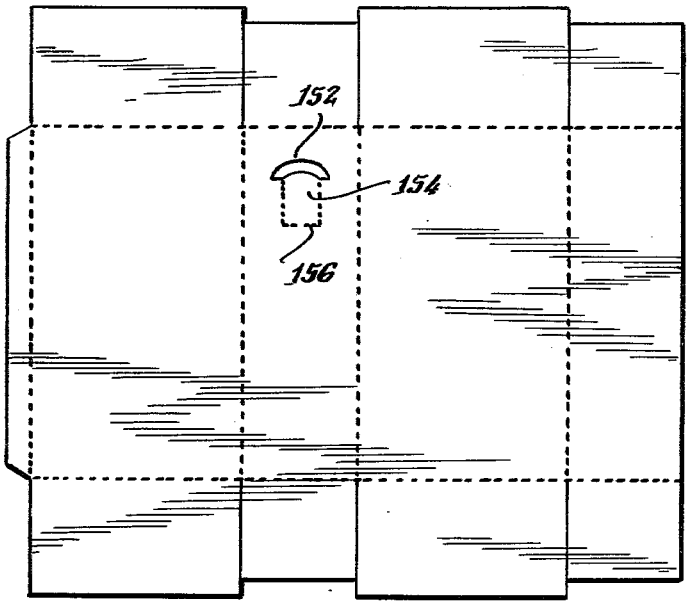
FIG. 12 is a plan view of a blank for an alternate embodiment of the invention.
Figure 13:
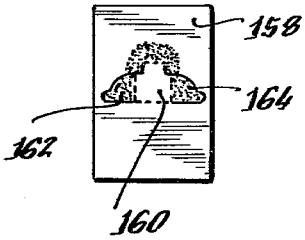
FIG. 13 is a plan view of an insert to be used in combination with the blank shown in FIG. 12.

In the embodiments described above, the inner and outer panels were integral members of a one-piece blank. An effective pour spout can be made with two separate pieces of sheet material. Referring to FIGS. 12 and 13, an outer panel with opening 152 and tab 154 is formed in the upper portion of a side panel 156 of a carton blank. The inner panel may be a generally rectangular square 158 of material having a width matching the width of the side wall panel 156. The panel 158 includes the inner tab member 160 and flanking wing members 162 and 164. The square of material can be bonded to the inside surface of the side wall panel 156 before or after the carton is formed.

While there have been described what are considered to be preferred embodiments of the present invention, variations and modifications therein will occur to those skilled in the art once they become aware of the basic concepts of the invention. Therefore, it is intended that the appended claims shall be construed to include all such variations and modifications as fall within the true spirit and scope of the invention.

What is claimed is:

1. A carton having closeable pour spout formed in one wall, comprising:

an outer panel having an opening therethrough and an outer tab having a first end hingedly connected to the remainder of the outer panel, a second opposite end defining a portion of the perimeter of the opening and side edges connecting the first and second ends of said outer tab; and an inner panel superimposed upon and bonded to said outer panel over a part of their facing surfaces, said inner panel including an inner tab forming a spout floor, said inner tab being bonded to said outer tab, said inner tab being hingedly connected along a bottom edge thereof to said inner panel in registry with said outer tab, and first and second integral wing members hingedly connected to opposite side edges of said inner tab, the surfaces of said first and second integral wing members which abut the outer panel being coated with a glue retarding coating to prevent bonding of said outer panel thereto, said inner panel further including first and second cut-outs, with a portion of the perimeter of each said cut-out being respectively defined by the bottom edge of said first and second wing members, said wing members being deformed inwardly to thereby form spaced side walls for the spout when said inner and outer tabs are pulled outwardly.

2. A carton as defined in claim 1 wherein the side edges of said outer tab are defined by parallel rows of perforations.

3. A carton as defined in claim 2 wherein each of said wing members has an arcuate edge and a projection extending from the arcuate edge, said projection being moveable into contact with the inner surface of said inner panel to limit outward movement of said tabs.

4. A carton as defined in claim 3 wherein said inner panel and said outer panel are integrally connected areas of a single piece of sheet material.

5. A carton as defined in claim 4 wherein said outer panel is a carton side wall and said inner panel is substantially as wide as said outer panel to provide a double thickness of material over at least a portion of the side wall.

6. A carton as defined in claim 5 wherein said inner panel is shorter than said outer panel.

7. A carton as defined in claim 4 wherein said pour spout is formed in a carton top wall with said outer panel and said inner panel being substantially of the same size.

8. A carton as defined in claim 7 wherein the remaining two sides of the carton include sealing flaps extending from their upper edges, said sealing flaps being folded inwardly of said inner panel and being secured thereto to reinforce the top wall of the carton.

9. A carton as defined in claim 4 wherein said inner panel is a side wall panel and said outer panel is an extension of an adjacent top wall panel of said carton.

10. A carton as defined in claim 9 wherein said extension is shorter than the side wall panel to which it is secured in face-to-face contact.

11. A blank for a carton having an integral pour spout, comprising:

generally rectangular front and back panels, each of said panels having generally rectangular panels hingedly connected to the upper and lower edges thereof;

a first generally rectangular side panel hingedly connected between adjacent side edges of said front and back panels, said first side wall panel having at least one generally rectangular panel hingedly connected to a free edge thereof;

a second generally rectangular side wall panel hingedly connected to a side edge of one of said front and back panels, said second side wall panel having generally rectangular panels hingedly connected to the upper and lower edges thereof;

a glue panel extending from the remaining side edge of one of said front and back panels, one of said panels including an opening therethrough and a tab member having a first end hingedly connected to said one panel, a second end defining a portion of the perimeter of said opening, and spaced side edges connecting said first and second ends, another of said panels including a tab hingedly connected to the panel and wing members extending from opposite edges of said tab, said wing members being coated with a glue retarding coating to prevent bonding of said one panel thereto, said another panel further including first and second cut-outs with a portion of the perimeter of each said cut-out being respectively defined by the bottom edge of said wing members; and said one panel and said another panel being in registry with one another in the erected carton.

12. A blank as defined in claim 11 wherein each of said wing members includes an arcuate edge portion.

13. A blank as defined in claim 12 wherein said one panel is the second side wall panel and said another panel is the glue panel of said carton.

14. A blank as defined in claim 12 wherein said one panel is the panel extending from the upper edge of one of said front and back panels and said another panel is the panel extending from the upper edge of the other of said front and back panels.

15. A blank as defined in claim 12 wherein said one panel is a panel extending from the upper edge of one of said front and back panels while said another panel is said first side wall panel.

* * * * *